US005350155A

United States Patent [19]

Burk

[11] Patent Number: 5,350,155

[45] Date of Patent: Sep. 27, 1994

[54] WIRE HOLDING FENCE POST ATTACHMENT ASSEMBLY

[76] Inventor: Lowell E. Burk, P.O. Box 356, Sharon Springs, Kans. 67758

[21] Appl. No.: 930,790

[22] Filed: Aug. 17, 1992

[51] Int. Cl.[5] ..... E04H 17/12

[52] U.S. Cl. ..... 256/48; 256/47; 256/49

[58] Field of Search ..... 256/47–49, 256/52–58, DIG. 3, DIG. 5, 2–3, 45–46, 1, 32; 403/397, 232.1, 4; 411/457, 461, 477; 52/155, 154, 156

[56] References Cited

U.S. PATENT DOCUMENTS

| | | | |
|---|---|---|---|
| 542,853 | 7/1895 | Hitchcock | 256/56 |
| 544,001 | 8/1895 | McKerns | 256/52 |
| 900,175 | 10/1908 | Knickerbocker | 256/52 X |
| 1,000,774 | 8/1911 | Buechele | 256/48 |
| 1,158,911 | 11/1915 | Ferris | 256/48 |
| 1,677,195 | 7/1928 | Miller | 256/52 |
| 2,238,523 | 4/1941 | Holst | 256/56 X |
| 3,411,754 | 11/1968 | Fahrenholz | 256/48 |
| 3,502,303 | 3/1970 | Bishop | 256/48 |
| 3,958,794 | 5/1976 | Suprunuk et al. | 256/47 X |
| 4,230,416 | 10/1980 | Gilb | 403/232.1 |
| 4,982,932 | 1/1991 | Baker | 256/1 X |

FOREIGN PATENT DOCUMENTS

| | | | |
|---|---|---|---|
| 2299545 | 8/1976 | France | 403/347 |

*Primary Examiner*—Randolph A. Reese
*Assistant Examiner*—Harry C. Kim
*Attorney, Agent, or Firm*—Phillip A. Rein

[57] ABSTRACT

A strand holding fence post attachment assembly having a main strand support and connector member mountable on a fence post member and operable with a strand restraining member, The main strand support and connector member includes a central body member integral with outer connector flange sections. The central body member is provided with strand receiving openings and cooperating lock pin receiving projections. The strand receiving openings are provided with outer tab sections to contact barbed wire strands and prevent the same from snagging with barb members thereon. The cooperating lock pin receiving projections are provided with openings therein to releasably receive the strand restraining member therein to keep the barbed wire strands from moving outwardly from respective ones of the strand receiving openings. The outer connector flange sections can be aligned with the central body section or having an arcuate connector flange with post connector openings therein of oblong shape for ease of attachment by connector members to a fence post member constructed of a wood material of various diameters.

8 Claims, 2 Drawing Sheets

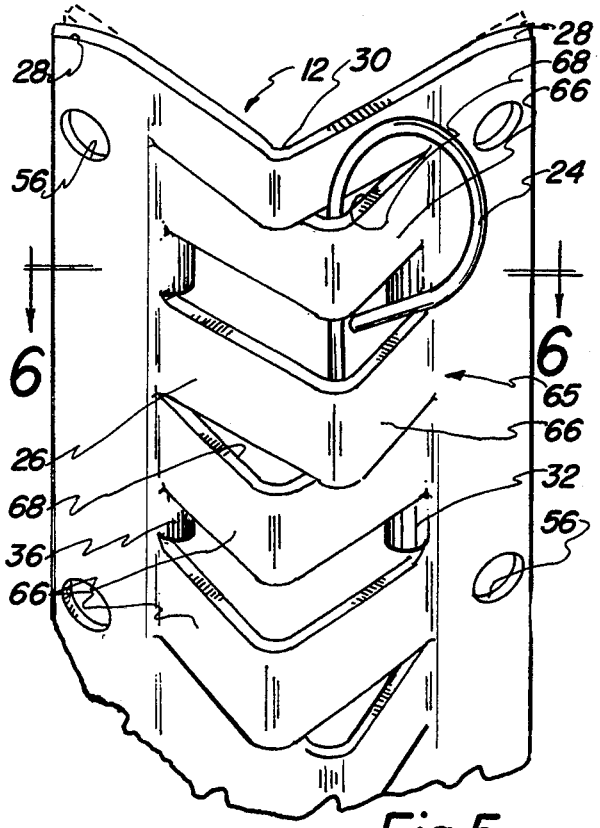
-Fig. 5-
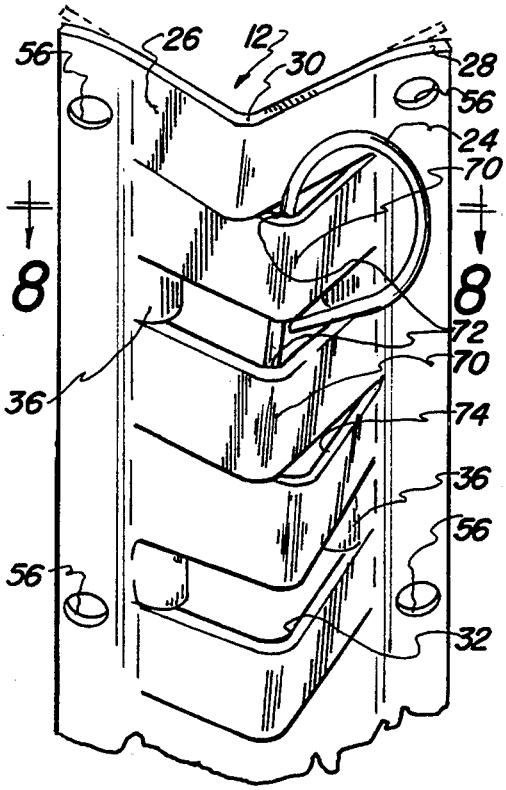
-Fig. 7-
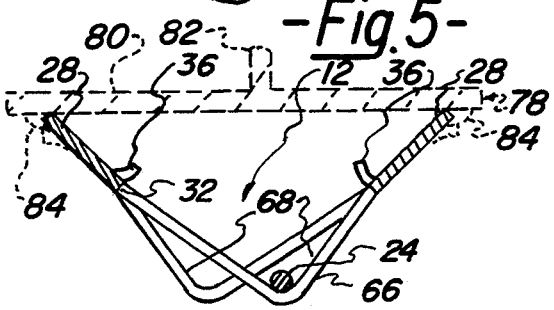
-Fig. 6-
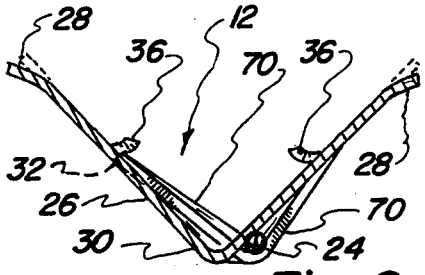
-Fig. 8-
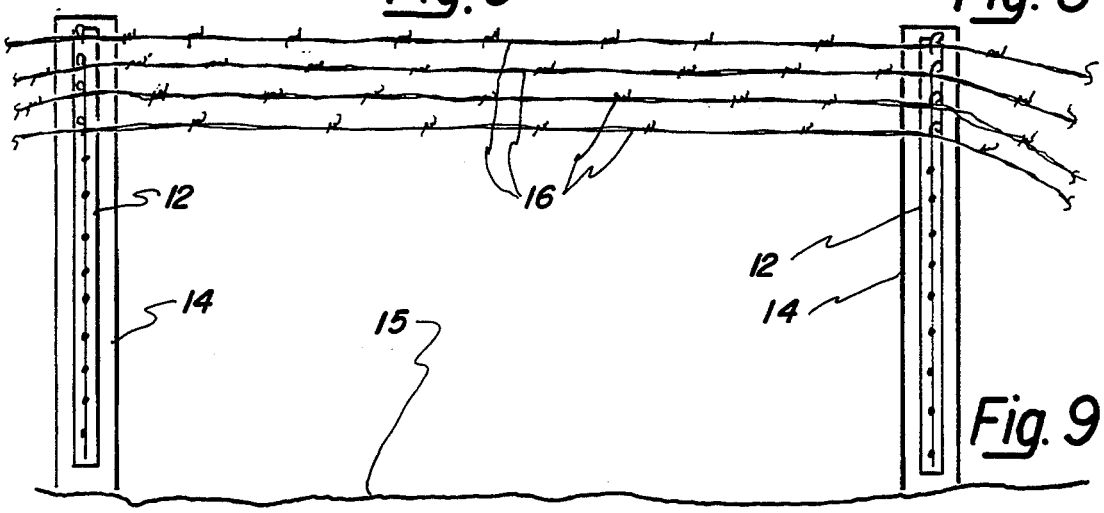
Fig. 9-

WIRE HOLDING FENCE POST ATTACHMENT ASSEMBLY

PRIOR ART

A patent search was conducted on this invention and revealed the following United States patents: Patent No. Invention Inventor

| U.S. Pat. No. | Invention | Inventor |
|---|---|---|
| 776,624 | FENCE POST | John Steward |
| 1,117,214 | FENCE POST | McFarland et al |
| 1,826,182 | WIRE SECURING MEANS FOR FENCE POSTS | Delmer C. Lee |
| 2,051,921 | BATTEN FOR WIRE FENCING | John W. Hoey (BRITISH PATENT) |
| 2,515,615 | FENCE POST | Walter R. Tetzlaff |
| 2,861,122 | ELECTRIC CONDUCTOR WIRE SPACER AND METHOD OF APPLYING SAME | Archibald T. Flower |
| 3,502,303 | FENCING | Charles E. Bishop |
| 4,982,932 | FENCE CLIP ASSEMBLY | Wayne Baker |

The Steward and McFarland et al patents disclose fence post structures both utilizing an elongated shaft or rod which is extended downwardly to prevent the fence wire from being dislodged from an anchor slot in which the fence wire has been inserted.

The Lee patent discloses a clip member for clamping against a wire member on a fence structure.

The Hoey patent discloses the use of a nail or wedge to hold a fence wire in place in a V-shaped fence post.

The Tetzlaff patent discloses a fence post having a nail or wedge member to secure a fence wire extended within a slot in a V-shaped post.

The Flower patent discloses a wire spacer having a separate lock pin for each fence wire member.

The Bishop patent discloses a V-shaped fence post having a locking rod or wire which is extended the entire length of a fence post to keep the wire members from moving outwardly of entrance connector slots.

The Baker patent discloses a fence clip assembly having a support structure secured as by nails to a wooden fence support and a nail member to prevent lateral movement of the fence wire.

PREFERRED EMBODIMENT OF THE INVENTION

In one preferred embodiment of this invention, a wire holding fence post attachment assembly is provided which is readily connectable to a fence post member which can be a wooden round or square post or a metal T-post member.

The purpose and function of the wire holding fence post attachment assembly is to receive and support wire strands, normally barbed wire strands, and prevent pulling loose from a fence post member which, under conventional mounting means, tends to wear out the fence post which must be frequently replaced. Additionally, in this invention, the wire strands can be easily moved up or down on the wire holding fence post attachment assembly in large or small increments for reasons to be explained.

The wire holding fence post attachment assembly includes 1) a main wire support and connector member which is to be attached to a fence post member; and 2) a wire restraining member releasably connectable to the main wire support and connector member operable to hold the wire strands in their proper position until selectively released therefrom.

The main wire support and connector member is of a preselected length, normally three to four feet, having a central body member with integral connector flange sections on outer opposite sides thereof. The central body member includes a primary V-shaped section having wire receiving openings thereon and cooperating lock pin receiving projections.

The primary V-shaped section is preferably comprised of first and second leg portions extended 90 degrees from each other.

The wire receiving openings have, on outer upright edges, inwardly projecting tab sections. The tab sections receive respective wire strands thereagainst and allow axial movement thereof without hindrance on contact with spaced barb members on a barbed wire strand.

The cooperating lock pin receiving projections include an upper pin projection and a lower pin projection which cooperate to receive the wire restraining member therein against an adjacent portion of the central body member.

The upper pin projection has a central semi-circular body portion integral with inclined leg portions. The lower pin projection is provided with a similar central body portion integral with perpendicular leg portions.

The upper and lower pin projections extend outwardly from the primary V-shaped section having a slot opening therein to receive the wire restraining member therethrough which is positioned transversely of the wire receiving opening.

The outer connector flange sections are provided with one of two embodiments being 1) an aligned connector flange; or 2) an arcuate connector flange. The arcuate connector flange is provided with connector openings of oblong shape operable to receive a connector member such as a nail therethrough for securing to an outer surface of a wooden fence post member.

The wire restraining member consists of a lock pin member having a main body section integral with an arcuate handle section. The arcuate handle section at an outer end is provided with a lock end portion which is positioned adjacent the main body section so as to provide a clamping, restraining action to prevent the lock pin member from being removed from the cooperating lock pin receiving projections when in a mounted locked condition.

In a second embodiment of the wire holding fence post attachment assembly as noted in FIGS. 5 and 6, the central body member is provided with the primary V-shaped section having spaced wire receiving openings thereon and having offset cooperating lock pin receiving projections.

The lock pin receiving projections are vertically aligned and having a pin receiving opening therein to receive the wire restraining member as described in the first embodiment.

The other features of this second embodiment are substantially identical as previously described in the first embodiment having the outer connector flange section provided with an aligned connector flange or an arcuate connector flange with the post connector openings therein.

In a third embodiment of the wire holding fence post attachment assembly as noted in FIGS. 7 and 8, the central body member is as previously described except having different cooperating lock pin receiving projections which are angled relative to the primary V-shaped section and operable to receive the wire restraining member therethrough similar to the first and second embodiments.

In a fourth embodiment as noted in FIG. 6, the main wire support and connector member has the central body member and outer connector flange section being an aligned connector flange and not being curved or arcuate. The outer ends of the primary V-shaped section are secured as by welding to a main support section of a T-post member.

OBJECTS OF THE INVENTION

One object of this invention is to provide a wire holding fence post attachment assembly which can be readily attached to a fence post member, whether constructed of a square or round wooden material or a metal material and is operable to receive and hold wire strands in a desired spaced relationship without contacting the fence post member and, due to its preferred metallic or plastic construction, will not be worn or damaged by contact with the wire strands supported thereon.

Another object of this invention is to provide a wire holding fence post attachment assembly which can be secured to a wooden fence post member and including a main wire support and connector member operable to releasably receive and support wire strands thereon and having a wire restraining member to hold the wire strands in a mounted condition but readily operable to move the wire strands vertically to prevent tumbleweeds and other such materials from collecting thereon when not used to contain farm animals in an enclosed area.

One other object of this invention is to provide a wire holding fence post attachment assembly readily connected to a fence post member including a plurality of spaced wire receiving openings therein to receive respective ones of wire strands and having a wire restraining member to prevent lateral movement of the wire strands from the respective wire receiving openings.

A further object of this invention is to provide a wire holding fence post attachment assembly having a main wire support and connector member with a central body member having cooperating offset lock pin receiving projections to receive a lock pin member therethrough and operable to receive the wire strand members at an adjustable distance therebetween.

One further object of this invention is to provide a wire holding fence post attachment assembly readily connectable to a fence post member and operable to receive spaced wire strands therein in one position to restrain farm animals by a completed fence assembly having means for easily releasing certain ones of the barb wire strands and moving them upwardly adjacent to each other to allow a large open space thereunder to prevent blowing plants, such as tumbleweeds, from collecting on the wire strands and applying a force which is damaging both to the wire strands and the spaced fence post members.

Still, one further object of this invention is to provide a wire holding fence post attachment assembly that is economical to manufacture; readily connectable to a fence post member, whether of metal or wood construction; easy to use and operate for attaching barb wire strands in a desired spaced relationship; operable to remove unnecessary contact and wear, especially on wooden fence post members, which normally requires their frequent replacement at considerable labor and material costs; and substantially maintenance free.

Various other objects, advantages, and features of the invention will become apparent to those skilled in the art from the following discussion, taken in conjunction with the accompanying drawings, in which:

FIGURES OF THE INVENTION

FIG. 5 is an upper fragmentary perspective view of a second embodiment of the wire holding fence post attachment assembly of this invention;

FIG. 6 is a sectional view taken along line 6—6 in FIG. 5 as attached to a T-post fence member illustrated in dotted lines;

FIG. 7 is a fragmentary upper perspective view of a third embodiment of the wire holding fence post attachment assembly of this invention;

FIG. 8 is a sectional view taken along line 8—8 in FIG. 7; and

FIG. 9 is a elevational view illustrating a wire holding fence post attachment assembly secured to spaced respective fence post members with barbed wire strand members interconnected therebetween and moved to an uppermost position on the fence post members.

Figure 1:
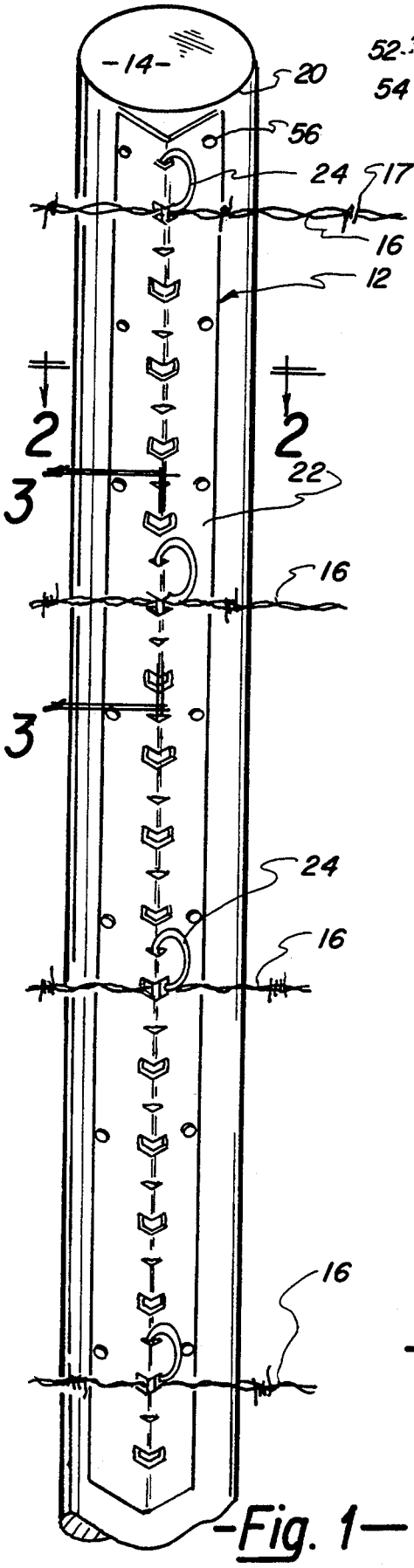
FIG. 1 is a perspective view of a wire holding fence post attachment assembly of this invention illustrated as mounted on a fence post member and having a plurality of spaced barbed wire strands connected thereto.

The following is a discussion and description of preferred specific embodiments of the wire holding fence post attachment assembly of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail and, in particular to FIG. 1, a wire or strand holding fence post attachment assembly of this invention, indicated generally at 12, is shown as attached to a fence post member 14 and having a plurality of spaced barbed wire strands 16 connected thereto. The wire strands 16 have spaced barb members 17 thereon.

The fence post member 14 is indicated of circular shape but could be of round or square shape and constructed of wooden material or of a conventional T-shaped metal post member as noted in dotted lines in FIG. 6.

The wire holding fence post attachment assembly 12 includes 1) a main wire or strand support and connector member 22 to be attached directly to the fence post member 14; and 2) a wire or strand restraining member or lock pin member 24 engagable with the main wire support and connector member 22 to selectively receive and restrain lateral movement of a respective barbed wire strand 16.

The main wire support and connector member 22 is provided with a central body member 26 having integral outer edges, each formed with a connector flange section 28. The central body member 26 is provided with a primary V-shaped section 30 having therein spaced wire or strand receiving openings 32 and cooperating lock pin receiving projections 34.

The central body member 26 is preferably constructed of a rigid plastic or metal material which is not subject to corrosion or abrasion wear from the mounted wire strands 16 mounted in the wire receiving openings 32.

The primary V-shaped section 30 has a pair of cooperating leg sections 35 integral in a preferred 90 degree conjunction.

Each of the wire receiving openings 32 are of generally rectangular shape having outer ends thereof formed with outer arcuate tab sections 36. The outer tab sections 36 are punched during manufacture of the wire receiving openings 32 in the central body member 26 and operable to prevent snagging conflict with the barb members 17 on the wire strands 16 mounted thereagainst as will be explained.

The cooperating lock pin receiving projections 34 include an upper pin projection 38 and a lower pin projection 40. The upper pin projection 38 is provided with a central semi-circular body portion 42 integral with inclined leg portions 44. The central semi-circular body portion 42 is provided with a slot opening 46 of a size to receive the wire restraining member 24 therethrough in a manner to be explained.

The lower pin projection 40 is provided with a central body portion 48 formed generally at 90 degrees with integral perpendicular leg portions 50.

Figure 3:
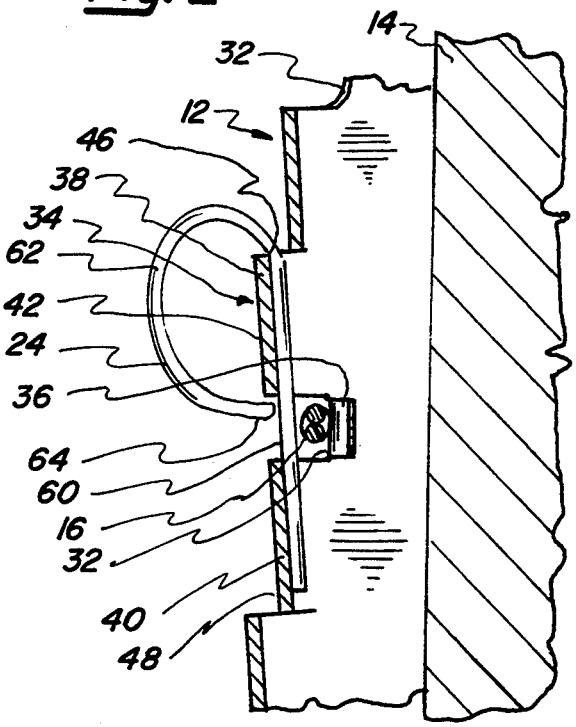
FIG. 3 is an enlarged fragmentary sectional view taken along line 3—3 in FIG. 1.

The central body portion 48 in cooperation with the slot opening 46 in the central semi-circular body portion 42 is operable to receive a wire restraining member 24 therethrough to contain a wire strand 16 within the respective wire receiving opening 32 as best noted in FIG. 3.

As noted in FIG. 1, it is seen that numerous ones of the cooperating lock pin receiving projections 34 are provided so that the wire strand members 16 have numerous selective places to be mounted along the main wire support and connector member 32 as noted in FIG. 1 and in adjacent positions as shown in FIG. 9 for reasons to be explained.

Figure 2:
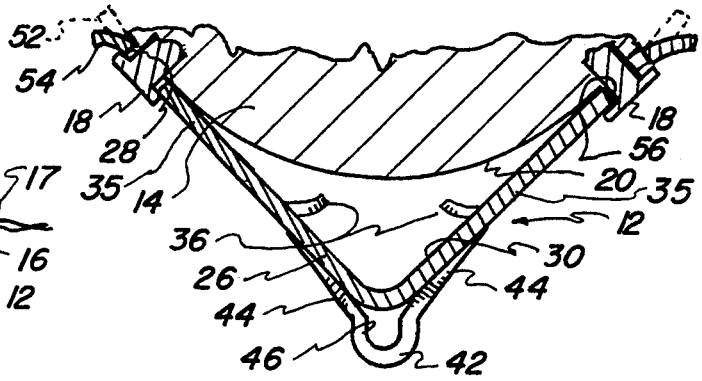
FIG. 2 is an enlarged fragmentary sectional view taken along line 2—2 in FIG. 1.

The outer connector flange sections 28 are provided with one of two embodiments being 1) an aligned connector flange 52 aligned with respective outer leg sections 35 of the primary V-shaped section 30; or 2) an arcuate connector flange 54 which is curved outwardly for ease of mounting on the fence post member 14 as shown in FIG. 2.

Figure 4:
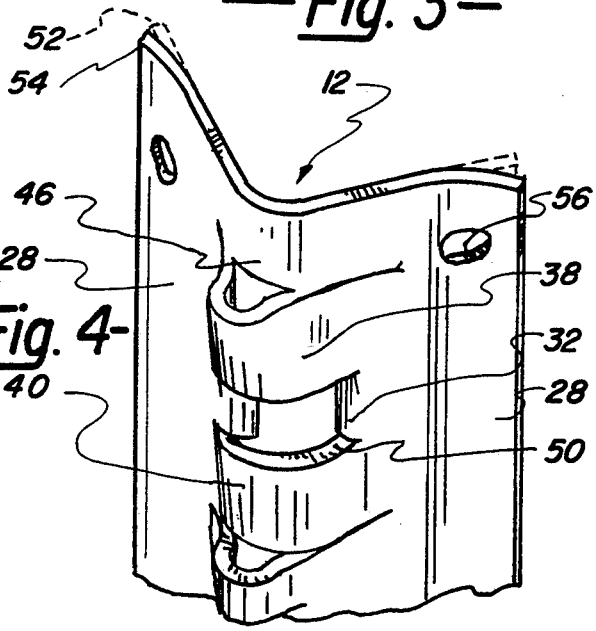
FIG. 4 is a fragmentary perspective view of an upper end portion of the wire holding fence post attachment assembly of this invention.

Both the aligned connector flange 52 and the arcuate connector flange 54 are provided with post connector openings 56 preferably of an oblong shape as best shown in FIG. 4. The oblong shape of the post connector openings 56, having a maximum axis perpendicular to a longitudinal axis of the main wire support and connector member 22, allows for ease of mounting against a fence post member 14 of wooden construction, whether it be of a 3, 4, or 5 inch diameter, as the oblong shape receives a nail or anchor member to be inserted therethrough at various angles, such as 90 degrees to each other. This prevents the nail members from pulling loose from the respective fence post members 14 on pressure being applied to the wire strands 16 as shown in FIG. 2.

As noted in FIG. 3, the wire restraining member or lock pin member 24 includes a main body section 60 integral with an arcuate handle section 62. The main body section 60 is of a length to substantially equal the combined upright length of the upper pin projection 38 and the lower pin projection 40 as noted in FIG. 3.

The arcuate handle section 62 has an outer lock end portion 64 which is placed in close relationship to the main body section 60. The arcuate handle section 62 provides an easy means of grasping and having a spring bias therein to hold in the position noted in FIG. 3 with the outer lock end portion 64 adjacent the main body section 60 with a distance therebetween less than the thickness of the cooperating lock pin receiving projections 34. This achieves a locked retaining function therein so that the wire restraining member 24 cannot be inadvertently removed by a contacting animal, weather conditions, or the like.

A second embodiment of a main wire support and connector member 22 of the wire holding fence post attachment assembly 12 is noted in FIGS. 5 and 6. More specifically in this embodiment, a central body member 26 is provided having the previously described primary V-shaped section 30, spaced wire receiving opening 32, but having a different type of cooperating lock pin receiving projections 65.

The cooperating lock pin receiving projections 65 include a pair of identical adjacent pin receiving projections 66, each having a pin receiving opening 68 and vertically aligned to receive the wire restraining member 24 therethrough as noted in FIG. 5.

In a third embodiment of a main wire support and connector member 22 of the wire holding fence post attachment assembly 12 of this invention as noted in FIGS. 7 and 8, the central body member 26 is as previously described except having cooperating lock pin receiving projections 70 being adjacent, inclined pin receiving projections 72 having pin receiving openings 74 extended at an angle relative to each other. The pin receiving projections 72 are substantially identical except extended at a different angular position relative to the first and second embodiments.

USE AND OPERATION OF THE INVENTION

In the use and operation of the wire holding fence post attachment assembly 12 of this invention as noted in FIGS. 1 and 4, a plurality of fence post members 14, being of a round wood construction, are mounted in spaced, respective vertical positions on a ground support 15 as noted in FIG. 9.

The first step would be to mount a wire holding fence post attachment assembly 12 to an outer curved surface 20 of the fence post member 14 along its longitudinal axis as noted in FIG. 1.

The wire holding fence post attachment assembly 12 can be of any desirable length but normally a 3 to 4 foot length would be sufficient for most animal restraining usage.

When attached to the outer curved surface 20, it is obvious that the central body member 26 and, more specifically, the outer connector flange section 28 are placed against the outer curved surface 20 of the fence post member 14 and secured thereto by a plurality of connector or anchor members 18 which are normally galvanized nail members.

The post connector openings 56, being of an oblong shape as noted in FIGS. 2, 5, and 7, allow for the connector members or nails 18 to vary in angular relationship to the oblong post connector openings 56 for connecting to a fence post member 14 whether it be 3, 4, or 5 inches in diameter.

On building of a fence post assembly, it is noted that the barbed wire strands 16 are moved or stretched between spaced fence post members 14 and the barbed wire strands 16 are placed within the respective wire receiving openings 32 and against the outer tab sections 36. When in this position as noted in FIG. 3, the wire restraining member 24, being the lock pin member, is inserted within the aligned slot opening 46 in the upper pin projection 38 and a similar opening in the lower pin projection 40 and moved downward therein to the assemblied locked condition as noted in FIG. 3.

In this condition, it is seen that the respective wire strands 16 are restrained by contact with the outer tab section 36 and the main body sections 60 of the wire restraining member 24.

The inwardly projecting outer tab sections 36 are important as they allow for longitudinal axial movement of the respective barbed wire strands 16 without becoming entangled on a barb member 17.

In this process of mounting a respective barb wire strand 16 within selective spaced ones of the wire receiving openings 32, the achieved result is obtained with the four strand fence post assembly as noted in FIG. 1.

It is obvious that the wire strands 16 can be removed for replacement or vertical movement by pulling outwardly on the arcuate handle section 62 of the wire restraining member 24 and moving upwardly and outwardly from its interconnections to the cooperating lock pin receiving projections 34.

The removal of the wire strands 16 is desirable for moving to upper adjacent positions as noted in FIG. 9 whereupon the wire restraining members 24 are re-connected in adjacent ones of the cooperating lock pin receiving projections 34 to achieve the close relationship as noted in FIG. 9.

One purpose and function of moving the barb wire strands 16 is that certain pasture fields are removed of grazing animals so that the grass therein is allowed to grow for future grazing purposes. However, in those cases with the prior art use of fence post assemblies, this was not readily possible and, in moving the barbed wire strands 16 from prior art wooden fence post members, this would entail a process of nailing and unnailing which, in a short period of time, deteriorates the respective wooden fence post members 14 which would then have to be replaced in an expensive and labor extensive operation.

The reason for moving the barbed wire strands 16 to the position of FIG. 9 is to prevent tumbling tumbleweeds and other blowing plants from accumulating on the barbed wire strands 16 which requires frequent repair of the fence post members 14.

In a second embodiment of this invention as noted in FIG. 6, it is seen that a main wire support and connector member 22 can be attached to an upright T-post fence 78 as by welding thereto. More specifically, the fence post member 14 is a T-post member 78 of a metal construction having a main support section 80 integral with a perpendicularly extended support leg section 82 as shown in FIG. 6.

The central body member 26, though the outer connector flange sections 28, is connected to an outer surface of the support section 80 as by weld sections 84.

The use and operation of the embodiment as attached to the T-post member 78 is as previously described in the first embodiment.

The wire holding fence post attachment assembly is readily attached as by welding or nails to a fence post member and provides a support for spaced wire strands which is economical to manufacture; easy to install; durable in operation; and easy to use for attaching and moving wire strands to spaced positions to restrain grazing animals in a selected area or being moved upwardly to adjacent positions to allow plants, such as tumbleweeds, to blow therethrough.

While the invention has been described in conjunction with preferred specific embodiments thereof, it will be understood this description is intended to illustrate and not to limit the scope of the invention, which is defined by the following claims:

I claim:

1. A strand holding fence post attachment adapted to be connected to a fence post member to support fence strand members thereon, comprising:

a) a main strand support and connector member includes a rigid central body member of generally V-shape having a fence strand receiving opening with an adjacent lock pin receiving projection;

b) a lock pin member releasably mounted in said lock pin receiving projection to restrain lateral movement of a fence strand member in said strand receiving opening;

c) said central body member integral with outer connector flange sections extended perpendicular to each other;

d) said outer connector flange sections engagable and connectable to an outer surface of the fence post member by an anchor member;

e) said central body member having a pair of cooperating ones of said lock pin receiving projections mounted on opposite sides of said strand receiving opening;

f) said lock pin receiving projections offset relative to each other to receive respective ones of said lock pin members therein; and g) said lock pin members are individually removable from respective ones of said lock pin receiving projections without interference with each other due to the offset relationship;

whereby said lock pin member is mounted in said lock pin receiving projections transversely of said strand receiving opening to hold the fence strand member therein and restrict lateral movement thereof while allowing axial movement.

2. A strand holding fence post attachment assembly adapted to be secured to a fence post to releasably support fence strand members thereon, comprising:

a) a main strand support and connector member having a central body member of an arcuate shape with integral outer connector flange sections;

b) respective ones of said connector flange sections engagable through vertical line contact with an outer diameter surface of the fence post;

c) said central body member includes a plurality of vertically spaced fence strand receiving openings and a lock pin receiving projection having an upper pin projection and a lower pin projection positioned respectively above and below respective ones of said fence strand receiving openings;

d) a lock pin member having a main body section integral with a handle section;

e) said main body section mounted in said pin receiving projection and of a length equal to or less than the height of said upper pin projection, said fence strand receiving opening, and said lower pin projection;

f) said handle section having a biased lock end portion positioned adjacent said main body section;

g) said lock end portion biased outwardly from said main body section on insertion into respective ones of said lock pin receiving projections; and h) said lock end portion positioned adjacent a portion of said main body section in respective ones of said fence strand receiving opening to present a locking feature and prevent unintentional movement of said lock pin member from respective ones of said lock pin receiving projections;

whereby said main body section is protected against dislodging vertical movement by a contacting animal or weather conditions.

3. A strand holding fence post attachment assembly adapted to be secured to a fence post to releasably support fence strand members thereon, comprising:

a) a main strand support and connector member mountable on the fence post member and having a lock pin member releasably connected to said main strand support and connector member to hold a fence strand member thereon;

b) said main strand support and connector member includes a central body section of generally V-shape having a plurality of spaced strand receiving openings and a pair of vertically aligned lock pin receiving projections cooperating with adjacent, respective ones of said strand receiving openings;

c) one of said lock pin members respectively mounted in said pin receiving projections and transversely of respective ones of said strand receiving openings to prevent lateral movement of respective ones of the fence strand members therefrom; and d) each of said strand receiving openings having outer tab section extended inwardly of said central body section operable to contact respective ones of fence strand members mounted therein while permitting unrestricted longitudinal movement thereof.

4. A strand holding fence post attachment assembly adapted to be secured to a fence post to releasably support fence strand members thereon, comprising:

a) a main strand support and connector member having a central body member of an arcuate shape with integral outer connector flange sections;

b) respective ones of said connector flange sections engagable through vertical line contact with an outer diameter surface of the fence post;

c) said central body member includes a plurality of vertically spaced fence strand receiving openings and a lock pin receiving projection having an upper pin projection and a lower pin projection positioned respectively above and below respective ones of said fence strand receiving openings;

d) a lock pin member having a main body section integral with a handle section;

e) said main body section mounted in said pin receiving projection and of a length equal to or less than the height of said upper pin projection, said fence strand receiving opening, and said lower pin projection;

f) each of said fence strand receiving openings of a rectangular shape having upright outer edges formed with inwardly projecting tab sections; and g) said tab sections engagable with respective ones of the fence strand members to permit unrestricted longitudinal movement thereof despite wire barbs on the fence strand members;

whereby said main body section is protected against dislodging vertical movement by a contacting animal or weather conditions.

5. A strand holding fence post attachment adapted to be secured to a fence post member to support fence strand members thereon, comprising:

a) a main strand support and connector member includes a central body member having a fence strand receiving opening with an adjacent lock pin receiving projection;

b) a lock pin member releasably mounted in said lock pin receiving projection to restrain lateral movement of a fence strand member in said strand receiving opening;

c) said central body member having a pair of cooperating ones of said lock pin receiving projections mounted on opposite sides of said strand receiving opening;

d) said lock pin receiving projections offset relative to each other to receive respective ones of said lock pin members therein; and e) said lock pin members are individually removable from respective ones of said lock pin receiving projections without interference with each other due to the offset relationship;

whereby said lock pin member is mounted in said offset lock pin receiving projections transversely of said strand receiving opening to hold the fence strand member therein and restrict lateral movement thereof while allowing axial movement.

6. A strand holding fence post attachment assembly adapted to be secured to a fence post to releasably support fence strand members thereon, comprising:

a) a main strand support and connector member having a central body member;

b) said central body member includes a plurality of vertically spaced fence strand receiving openings and a lock pin receiving projection having an upper pin projection and a lower pin projection positioned respectively above and below respective ones of said fence strand receiving openings;

c) a lock pin member having a main body section integral with a handle section;

d) said main body section mounted in said pin receiving projection and of a length equal to or less than the height of said upper pin projection, said fence strand receiving opening, and said lower pin projection;

e) said handle section having a lock end portion positioned adjacent said main body section; and f) said lock end portion positioned adjacent a portion of said main body section in respective ones of said fence strand receiving opening to present a locking feature and prevent unintentional movement of said lock pin member from respective ones of said lock pin receiving projections;

whereby said main body section is protected against dislodging vertical movement by a contacting animal or weather conditions.

7. A strand holding fence post attachment assembly adapted to be secured to a fence post to releasably support fence strand members thereon, comprising:

a) a main strand support and connector member mountable on the fence post member and having a lock pin member releasably connected to said main strand support and connector member to hold a fence strand member thereon;

b) said main strand support and connector member includes a plurality of spaced strand receiving openings and a pair of vertically aligned lock pin receiving projections cooperating with adjacent, respective ones of said strand receiving openings;

c) said pairs of said lock pin receiving projections offset relative to adjacent ones of said lock pin receiving projections;

d) one of said lock pin members respectively mounted in said pin receiving projections and transversely of respective ones of said strand receiving openings to prevent lateral movement of respective ones of the fence strand members therefrom; and e) each of said lock pin members selectively and individually removable from said pin receiving projections for movement and repair of respective ones of fence strand members mounted therein.

8. A strand holding fence post attachment assembly adapted to be secured to a fence post to releasably support fence strand members thereon, comprising:

a) a main strand support and connector member having a central body member with outer connector flange sections;

b) respective ones of said connector flange sections engagable with an outer surface of the fence post;

c) said central body member includes a plurality of vertically spaced fence strand receiving openings and a lock pin receiving projection having an upper pin projection and a lower pin projection positioned respectively above and below respective ones of said fence strand receiving openings;

d) a lock pin member having a main body section;

e) each of said fence strand receiving openings having outer edges formed with inwardly projecting tab sections; and f) said tab sections engagable with respective ones of the fence strand members to permit unrestricted longitudinal movement thereof despite wire barbs on the fence strand members;

whereby said main body section is protected against dislodging vertical movement by a contacting animal or weather conditions.

* * * * *